US009643751B2

(12) United States Patent
Roeterdink et al.

(10) Patent No.: US 9,643,751 B2
(45) Date of Patent: May 9, 2017

(54) LID WITH SEALING FOIL COMPRISING RETAINING MEANS

(75) Inventors: Johan Willem Roeterdink, Epse (NL); Gerardus Johannes Josephus Tielbeke, Raalte (NL)

(73) Assignee: Ardagh MP Group Netherlands B.V., Deventer (NL)

( * ) Notice: Subject to any disclaimer, the term of this patent is extended or adjusted under 35 U.S.C. 154(b) by 1208 days.

(21) Appl. No.: 10/499,924

(22) PCT Filed: Dec. 17, 2002

(86) PCT No.: PCT/EP02/14521

§ 371 (c)(1),
(2), (4) Date: Oct. 19, 2004

(87) PCT Pub. No.: WO03/005803

PCT Pub. Date: Jul. 3, 2003

(65) Prior Publication Data

US 2005/0045633 A1 Mar. 3, 2005

(30) Foreign Application Priority Data

Dec. 20, 2001 (EP) ..... 01205059

(51) Int. Cl.
*B65D 17/50* (2006.01)

(52) U.S. Cl.
CPC .... *B65D 17/502* (2013.01); *B65D 2517/0013* (2013.01); *B65D 2517/0061* (2013.01); *B65D 2517/5027* (2013.01); *B65D 2517/5078* (2013.01)

(58) Field of Classification Search
CPC ..... B65D 17/502; B65D 2517/0013; B65D 2517/5078; B65D 2517/5027; B65D 2517/0061
USPC ..... 220/257.2, 258.1, 258.2, 269, 359.2; 215/232
See application file for complete search history.

(56) References Cited

U.S. PATENT DOCUMENTS

| | | | | |
|---|---|---|---|---|
| 3,018,024 | A * | 1/1962 | Foord | 222/498 |
| 3,561,631 | A * | 2/1971 | Hatfield et al. | 215/255 |
| 3,946,895 | A * | 3/1976 | Pugh | 220/269 |
| 3,981,412 | A * | 9/1976 | Asmus | 220/270 |
| 4,094,460 | A * | 6/1978 | Scanga et al. | 229/123.1 |
| 4,176,760 | A * | 12/1979 | Roth | 220/359.2 |
| 4,834,259 | A * | 5/1989 | Kubis et al. | 220/359.2 |
| 5,054,642 | A * | 10/1991 | Yoshida | 220/276 |
| 5,287,983 | A * | 2/1994 | Reil et al. | 220/258.1 |
| 5,725,120 | A * | 3/1998 | Ramsey et al. | 220/276 |
| 5,823,404 | A * | 10/1998 | Ronchail | 222/535 |
| 6,102,236 | A | 8/2000 | Ohlsson et al. | |
| 6,131,804 | A * | 10/2000 | Julian | 229/125.09 |
| 2005/0247712 | A1* | 11/2005 | Wallis et al. | 220/359.2 |
| 2005/0252918 | A1* | 11/2005 | McKnight et al. | 220/359.3 |

* cited by examiner

*Primary Examiner* — James N Smalley
(74) *Attorney, Agent, or Firm* — The Webb Law Firm

(57) ABSTRACT

The invention relates to a lid (1) for a can for foodstuff, paint and so on, which lid comprises: ringlike bare part (2) defining a opening (3); a sealing foil (4) arranged an the base part and covering the opening; a lip (5) arranged with one end to the foil for tearing the foil; retaining means for retaining a free end of the lip adjacent the sealing foil, whereby the retaining means comprise a first retaining part being part (7) of the sealing foil and a second retaining part being (8) part or the lip.

4 Claims, 4 Drawing Sheets

LID WITH SEALING FOIL COMPRISING RETAINING MEANS

The invention relates to a lid for a can for foodstuff, paint and so on, which lid comprises:

a ringlike base part defining an opening;

a sealing foil arranged on the base part and covering the opening;

a lip arranged with one end to the foil for tearing the foil; and retaining means for retaining a free end of the lip adjacent the sealing foil.

Such a lid is used for cans, which comprise for example milk powder. These cans are filled under low pressure, such that the sealing foil of the lid will bend inside which causes the lip to bend up from the sealing foil. This causes problems during the further handling of such a can. The lip could get stuck between parts of a handling machine or influence the functioning of the machine.

Such cans could also be sterilized. As a result of this, the sealing foil puffs up, by which again the lip bends away from the sealing foil.

Currently, this bending of the lip is prevented by glueing the lip to the sealing foil. This glueing process has a number of disadvantages. First of all it is an expensive process, which is difficult to control. When the can is used for foodstuff, the glue has to be approved to be used for application in the food industry. Secondly the glue has to fulfil a number of requirements, such as a high temperature stability, especially when the lid is sterilized, a low tearing force, as the sealing foil has to be able to be removed easily. A third disadvantage of the glueing process is that the application of the glue has its speed limitation. The glue has always a rather high viscosity, which restricts the speed of application.

It is an object of the invention to provide a lid according to the preamble, which eliminate the above mentioned disadvantages.

This object is achieved by a lid according to the invention, which is characterized in that the retaining means comprise a first retaining part being part of the sealing foil and a second retaining part being part of the lip.

As both the first and second retaining part are part of respectively the sealing foil and the lip, no additional material has to be added in order to provide the retaining means. A robust connection of the lip to the sealing foil is provided. This prevents bending of the lip, which could influence further handling of the lid.

According to a preferred embodiment the first and second retaining part have a shape defined connection. So due to the shape of both retaining parts, the connection is accomplished. There is no need for any frictional forces or adherents such as with a glue connection.

According to another embodiment of the invention, the first and second retaining parts each comprise a projection which engage with each other.

Preferably the projections have a substantially T-shaped cross-section.

By this T-shaped cross-section, both the first and second retaining parts have a shape defined connection. The T-shape of the first part will engage into the T-shape of the other part. Only by deformation of the lip material or the foil material, the connection could be disengaged.

In yet another preferred embodiment according to the invention the lid and the sealing foil are integral.

Preferably the lip is connected to the sealing foil, through a recessed or waist connection portion. This provides a large gripping area on the lip, while the exerted forces are transferred to the sealing foil through a small cross-section, which facilitates tearing of the sealing foil.

Furthermore, the sealing foil could comprise aluminum foil and/or steel foil.

The invention relates also to a method for manufacturing a lid according to the invention, which method comprises the steps of:

providing a ringlike base part defining an opening;

cutting a sealing foil out of a length of material;

arranging a lip with one end to the sealing foil;

arranging the sealing foil to the base part;

folding the lip back onto the sealing foil;

pressing a recess with a bottom in both the sealing foil and the lip; and butting both bottoms of the recesses, such that a connection is formed between the lip and the sealing foil.

By butting both bottoms of the recesses, the material of these bottoms will flow due to the butting, such that the thickness of the bottoms will decrease and the area of the bottom will increase. This will provide a shape defined connection between the lip and the sealing foil.

In a preferred embodiment of the method according to the invention the method comprises the step of stamping a profile into the sealing foil. This foil provides for a neat surface of the sealing foil, without any folds.

Preferably the stamping, pressing and butting are performed in one stroke. This will provide a very quick way of manufacturing a lid according to the invention.

These and other features of the invention will be elucidated in conjunction with the accompanying drawings.

Figure 1:
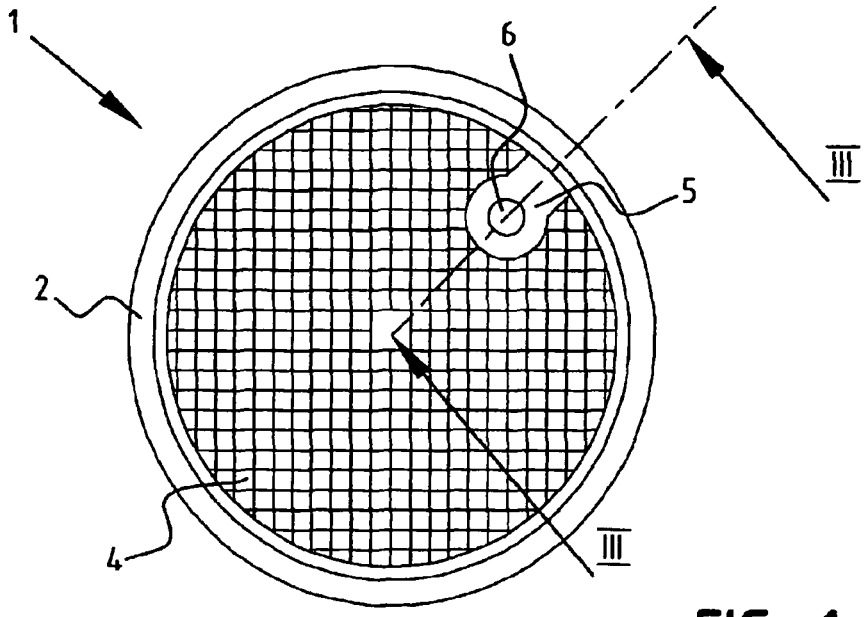
FIG. 1 shows an upper view of a lid according to the invention.
Figure 2:
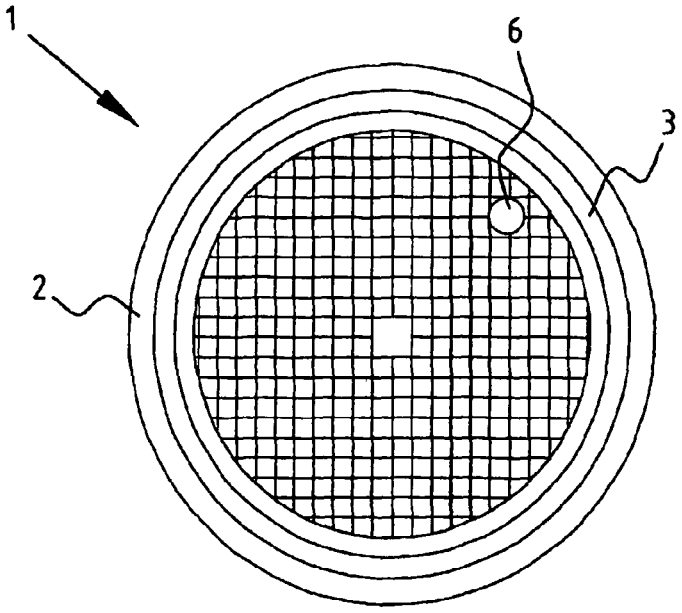
FIG. 2 shows a bottom view of the lid according to FIG. 1.

In FIGS. 1 and 2 a lid 1 according to the invention is shown. This lid comprises a ring-like base part 2 which defines an opening 3. A sealing foil 4 is arranged onto the ring-like base part 2 covering the opening 3. The sealing foil 4 is sealingly arranged to the base part 2.

Integral with the sealing foil 4 a lip 5 is provided. This lip 5 is attached to the sealing foil 4 through a retaining means 6, which resembles a rivet.

Figure 3:
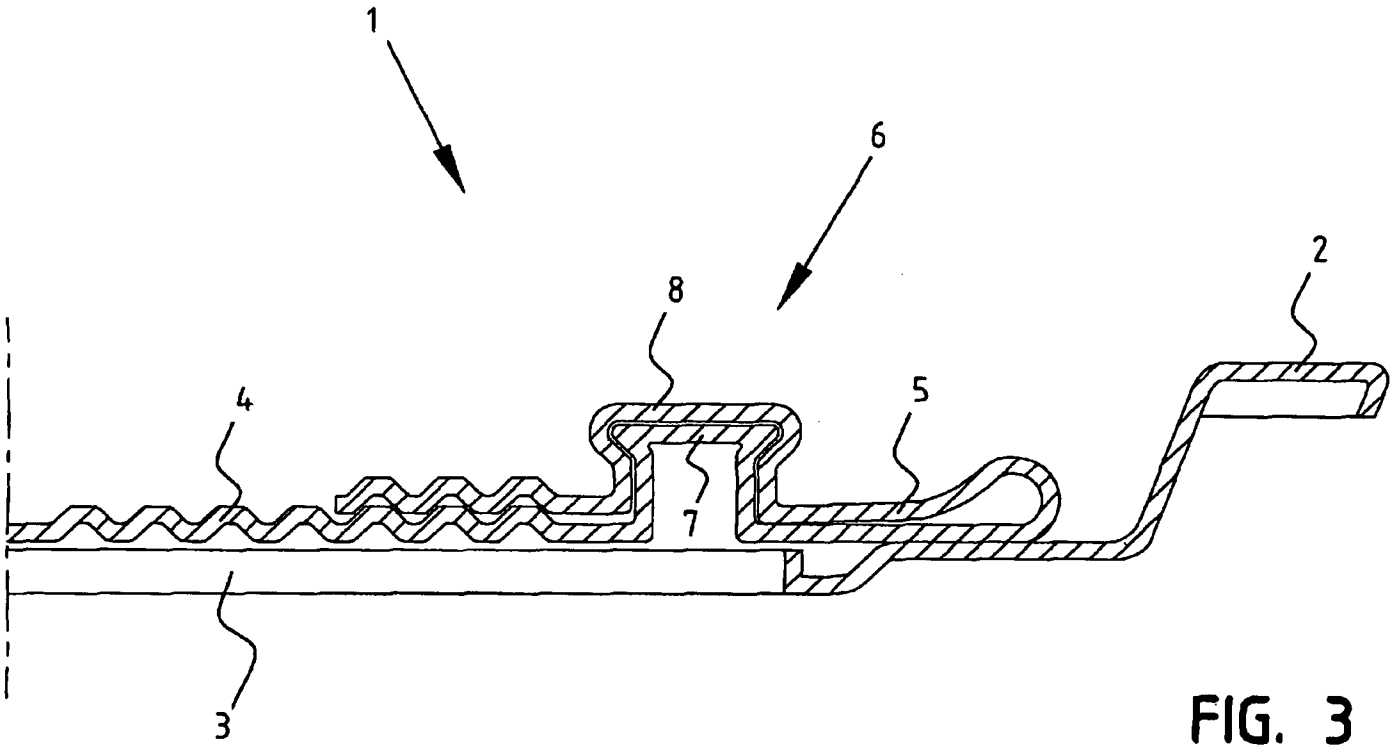
FIG. 3 shows a sectional view of the lid according to FIG. 1 taken along the line III-III.

In FIG. 3 a cross-sectional view of the lid according to FIG. 1 is shown. Clearly can be seen that the ring-like base part 2 defines an opening 3 onto which the sealing foil 4 is arranged. The lip 5 is integral with the sealing foil 4 and folded back onto the sealing foil 4. The lip 5 and the sealing foil 4 are connected by retaining means 6, which consists of a first T-shaped protrusion 7 which is arranged in a second T-shaped protrusion 8. Due to the T-shape the retaining action is accomplished.

Figure 4B:
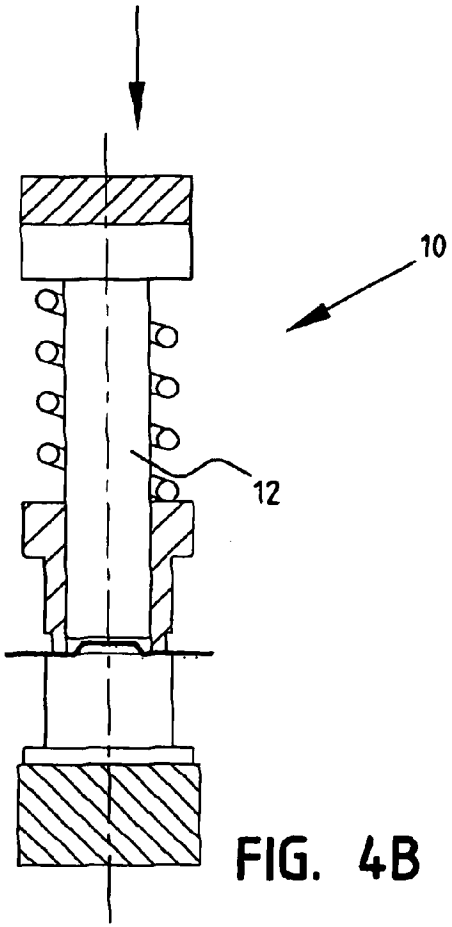
FIGS. 4A and 4B show two steps of a method according to the invention.
Figure 4A:
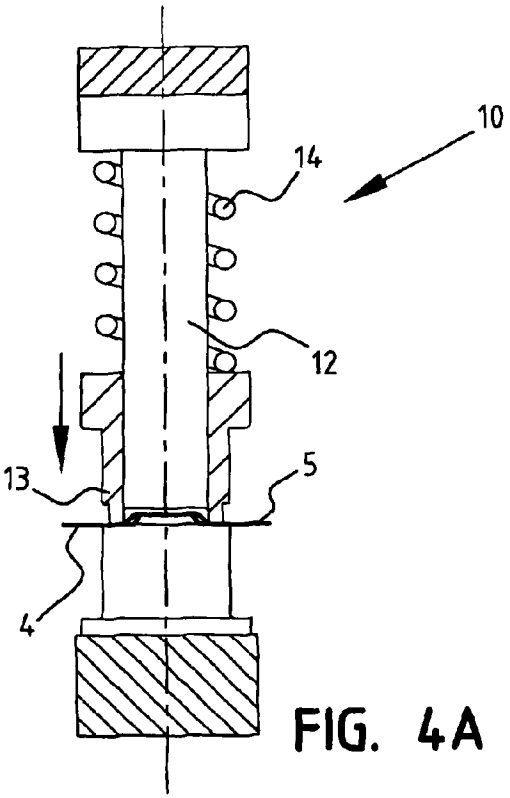

In FIG. 4A a tool 10 is shown with which a connection of a lip with a sealing foil can be achieved. The tool 10 has a lower die 11 and an upper die 12. On the upper die 12 a pressing member 13 is slidedly arranged and put under pressure by a spring 14.

Figure 5A:
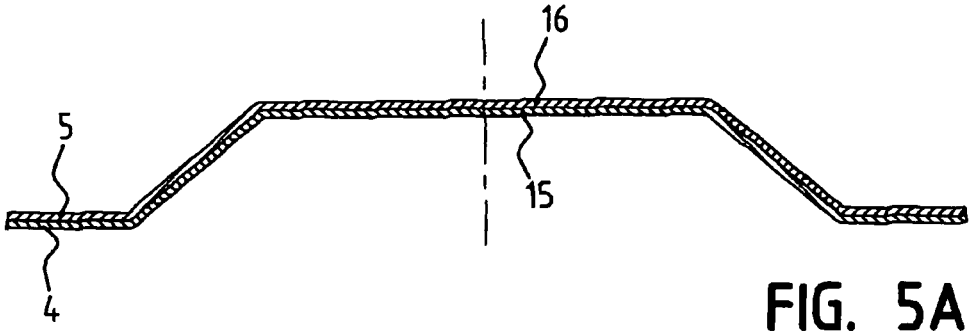
FIGS. 5A and 5B show a cross-sectional view of the deformation accomplished with the steps according to FIG. 4A and FIG. 4B.
Figure 5B:
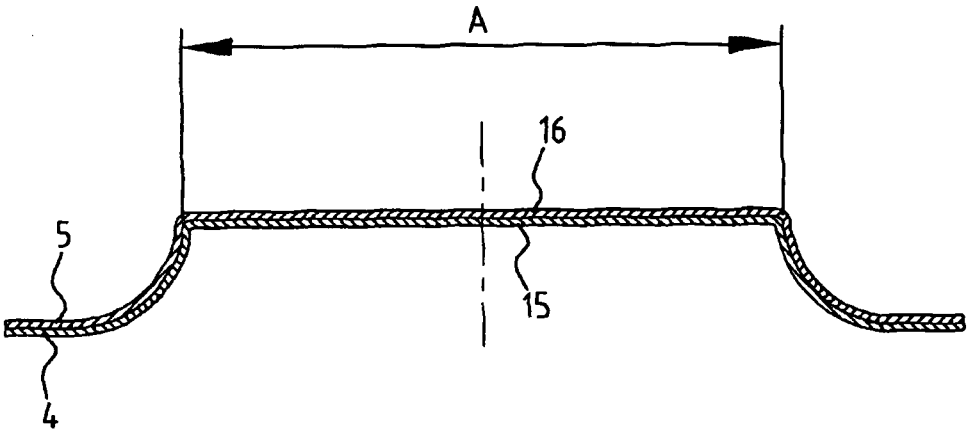

The sealing foil 4 and the lip 5 are brought onto the lower die 11. The upper die 12 together with the pressing member 13 is brought down onto the sealing foil 4 and the lip 5. The pressing member 13 will contact the lip 5 first through which a protrusion is pressed into the material of the foil and the lip (see FIG. 5A). After this protrusion is formed into both the sealing foil 4 and the lip 5, the upper die 12 is brought down further with force, such that the bottoms 15, 16 of the protrusions are butted. This causes the material of the bottoms 15, 16 to flow, such that the thickness of the bottoms 15, 16 reduces, but that the area A increases. This provides a T-shaped protrusion which connects both the sealing foil 4 and the lip 5.

The lip can only be disconnected from the sealing foil 4 by deforming the material of the lip 5. As this deformation is visible, this lid according to the invention provides also a tamper proof.

The invention claimed is:

1. A sealing lid for a can comprising:

a base part substantially shaped like a ring defining an opening;

a sealing foil arranged on the base part and covering the opening;

a peripheral lip unitary with the sealing foil and having a thickness that is equal to a thickness of the sealing foil, the peripheral lip coupled to the sealing foil to facilitate removing the foil from the base part arranged with a free end thereof folded back onto an upper surface of the sealing foil; and a releasable retaining means for releasably retaining the free end of the lip to the sealing foil, the releasable retaining means consisting of a first retaining part formed of the sealing foil integrally disposed on the upper surface of the sealing foil and a second retaining part formed of the sealing foil disposed on an underside of the peripheral lip, wherein the first retaining part and the second retaining part have a shape defined connection comprising projections which releasably engage with each other wherein the projections have a substantially T-shaped cross-section, and wherein lifting of the free end of the peripheral lip releases the first retaining means from the second retaining means while the sealing foil covers and closes the opening and subsequent action on the lifted free end of the peripheral lip opens the can by removing the sealing foil along with the unitary peripheral lip from the base part.

2. The sealing lid according to claim 1, wherein the lip and the sealing foil are integral.

3. The sealing lid according to claim 1, wherein the sealing foil is selected from among aluminum foil, steel foil and combinations of aluminum foil and steel foil.

4. A sealing lid for a can comprising:

a base part substantially shaped like a ring defining an opening;

a sealing foil arranged on the base part and covering the opening;

a peripheral lip unitary and integral with the sealing foil and having a thickness that is equal to a thickness of the sealing foil, the peripheral lip coupled to the sealing foil to facilitate removing the foil from the base part arranged with a free end thereof folded back onto an upper surface of the sealing foil; and a releasable retaining means for releasably retaining the free end of the lip to the sealing foil, the releasable retaining means consisting of a first retaining part formed of the sealing foil integrally disposed on the upper surface of the sealing foil and a second retaining part formed of the sealing foil disposed on an underside of the peripheral lip, wherein the first retaining part and the second retaining part have a shape defined connection comprising projections which releasably engage with each other wherein the projections have a substantially T-shaped cross-section, and wherein lifting of the free end of the peripheral lip releases the first retaining means from the second retaining means while the sealing foil covers and closes the opening and subsequent action on the lifted free end of the peripheral lip opens the can by removing the sealing foil along with the unitary peripheral lip from the base part, and wherein the sealing foil is selected from among aluminum foil, steel foil and combinations of aluminum foil and steel foil.

* * * * *